US006662618B2

(12) United States Patent
Wong

(10) Patent No.: US 6,662,618 B2
(45) Date of Patent: Dec. 16, 2003

(54) METHOD AND APPARATUS FOR CHECKING SHEET METAL FORMS

(75) Inventor: Daniel T Wong, Columbia, SC (US)

(73) Assignee: Intel Corporation, Santa Clara, CA (US)

( * ) Notice: Subject to any disclaimer, the term of this patent is extended or adjusted under 35 U.S.C. 154(b) by 120 days.

(21) Appl. No.: 09/955,650

(22) Filed: Sep. 17, 2001

(65) Prior Publication Data

US 2003/0051527 A1 Mar. 20, 2003

Related U.S. Application Data

(63) Continuation of application No. 09/537,914, filed on Mar. 28, 2000, now abandoned.

(51) Int. Cl.[7] ..... B21D 5/00
(52) U.S. Cl. ..... 72/379.2; 428/577; 428/595
(58) Field of Search ..... 72/31.1, 37, 325, 72/335, 379.2, 420, 461; 493/11, 12; 428/573, 577, 596, 595

(56) References Cited

U.S. PATENT DOCUMENTS

| | | | | |
|---|---|---|---|---|
| 1,431,173 A | * 10/1922 | O'Connor | ..... | 72/379.2 |
| 1,925,804 A | * 9/1933 | Hiering | ..... | 72/335 |
| 3,090,418 A | * 5/1963 | Marak | ..... | 72/415 |
| 4,243,495 A | * 1/1981 | Trott | ..... | 29/413 |
| 4,578,052 A | * 3/1986 | Engel et al. | ..... | 493/11 |
| 5,259,230 A | * 11/1993 | Beyers | ..... | 72/31.1 |

FOREIGN PATENT DOCUMENTS

| | | | | |
|---|---|---|---|---|
| DE | 76 657 | * 10/1970 | ..... | 72/379.2 |
| DE | 43 21 980 | * 1/1995 | ..... | 72/420 |
| GB | 2 034 207 | * 6/1980 | ..... | 72/379.2 |
| WO | WO82/03574 | * 10/1982 | ..... | 72/379.2 |

* cited by examiner

*Primary Examiner*—Lowell A. Larson
(74) *Attorney, Agent, or Firm*—Kenyon & Kenyon

(57) ABSTRACT

A method of manufacturing a workpiece is provided. The method includes forming a sheet of material having a predetermined shape. A physical marker is then formed on the sheet of material. The physical marker is formed to indicate a position on the sheet of material, where the sheet of material is to be bent.

20 Claims, 7 Drawing Sheets

METHOD AND APPARATUS FOR CHECKING SHEET METAL FORMS

CROSS REFERENCE TO RELATED APPLICATIONS

This application claims the benefit of co-pending U.S. patent application No. 09/537,914 filed on Mar. 28, 2000, which are incorporated herein by reference.

BACKGROUND OF THE INVENTION

1. Field of the Invention

The present invention relates generally to the forming of sheet metal and, more particularly, to techniques for determining whether sheet metal has been properly formed.

2. Description of the Related Art

Sheet metal is a material that is used in an almost infinite number of ways. It is conventionally used to provide physical support or physical structure in automobiles, furniture, televisions, and other commonly manufactured products. Because there are so many everyday uses for sheet metal, improvements to sheet metal fabrication may be felt by a wide variety of industries.

Sheet metal is also utilized in the electronic industry to provide physical support for electronic devices. In addition, sheet metal may also be used as a housing, a shock absorber or a mounting structure for a component such as a disk drive. Sheet metal is also used for other miscellaneous functions, such as for encasing a power supply or to direct air flow to provide ventilation to a target semiconductor device such as the central processing unit (CPU) or the motherboard of a computer.

As the demand for smaller electronic based devices and machines increase, manufacturers and designers struggle to build components with smaller dimensions that function in a smaller space. Therefore, the precision in which sheet metal parts are fabricated is becoming an increasingly important factor in the overall integrity of the finished package. In current designs, sheet metal must be fabricated within a low tolerance of error because of both the shrinking sizes of electronic components and tighter space limitations and constraints.

To precisely design a sheet metal part, manufacturers typically use computer aided design (CAD) and computer aided manufacturing (CAM) software programs. Not only are CAD/CAM programs able to design the actual structure of the sheet metal part, but the software may also be used to compute the dimensions of a flattened piece of sheet metal from which the sheet metal part is formed and the locations of all the appropriate forming lines to bend the sheet metal. This flattened piece of sheet metal, which is cut to the proper dimensions is called a blank.

A blank may be cut from a large piece of sheet metal by a hard tool stamping or a soft tool having a laser. While the laser offers many conveniences for cutting blanks for specialized sheet metal parts, hard tool stamping, similar to a "cookie cutter", are the standard for mass producing a sheet metal blank. The hard tool stamping cuts the blank by using a stamping die. Depending on the requirements of the finished product, the stamping die may be designed to cut a very precise blank with a very low error tolerance.

While blanks may be manufactured very precisely, the process of bending each blank into the finished sheet metal part is much less exact. Sheet metal is generally formed and shaped by a mechanical or hydraulic press brake machine. A press brake typically includes a slot for inserting a blank or any flattened portion of sheet metal. Most press brakes are manually fed by an operator who holds the workpiece between a punch and a die against an appropriate back stop.

The punch and die are male and female "V" shaped parts of the press brake, respectively, that shape the sheet metal. The sheet metal is inserted between a punch and a die by the operator. Then, the press brake is operated by mechanically or hydraulically forcing the punch and die together. Because the sheet metal is between the punch and die, it is bent into the same "V" shape. The punch and die may also be made into various other shapes such as a "W" depending on the particular need.

The back stop is a gauge that determines whether a piece of sheet metal has been properly positioned into the press brake. When a piece of sheet metal is properly positioned into the press brake, it comes into physical contact with the back stop, which then sends a signal indicating so. Because a press brake is manually operated, the sheet metal forming process is vulnerable to human error, even if a back stop is used. Errors are common because sheet metal is often awkward to handle and may at times be fed into the press brake several times at different angles. Therefore, sheet metal is often not properly positioned in to the press brake, in which case the bend or shape made by the punch and die will be incorrect and the sheet metal will be malformed.

Because errors in handling the sheet metal while using a press brake may be small, it is generally difficult to determine whether a piece of sheet metal was properly formed by the press brake. Precision measuring instruments such as calipers, coordinate measuring machines, micrometers, and gauges may be used to determine how precisely the sheet metal was formed into the desired part. The measurement may then be compared to the specifications on the engineering drawing or CAD file to see if the sheet metal has been properly formed.

However, taking each piece of metal and measuring it for accuracy along every forming line is difficult, time consuming, and potentially expensive. Furthermore, it may not be possible to measure each individual piece if the sheet metal pieces are part of an assembly. In view of the foregoing, it is desirable to have a method and apparatus that provides a marking on the forming line of a piece of sheet metal that allows an operator to visually identify whether there have been errors in the forming process.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION

A method and apparatus for making a physical marking along an imaginary forming line of a sheet metal part is provided. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1:
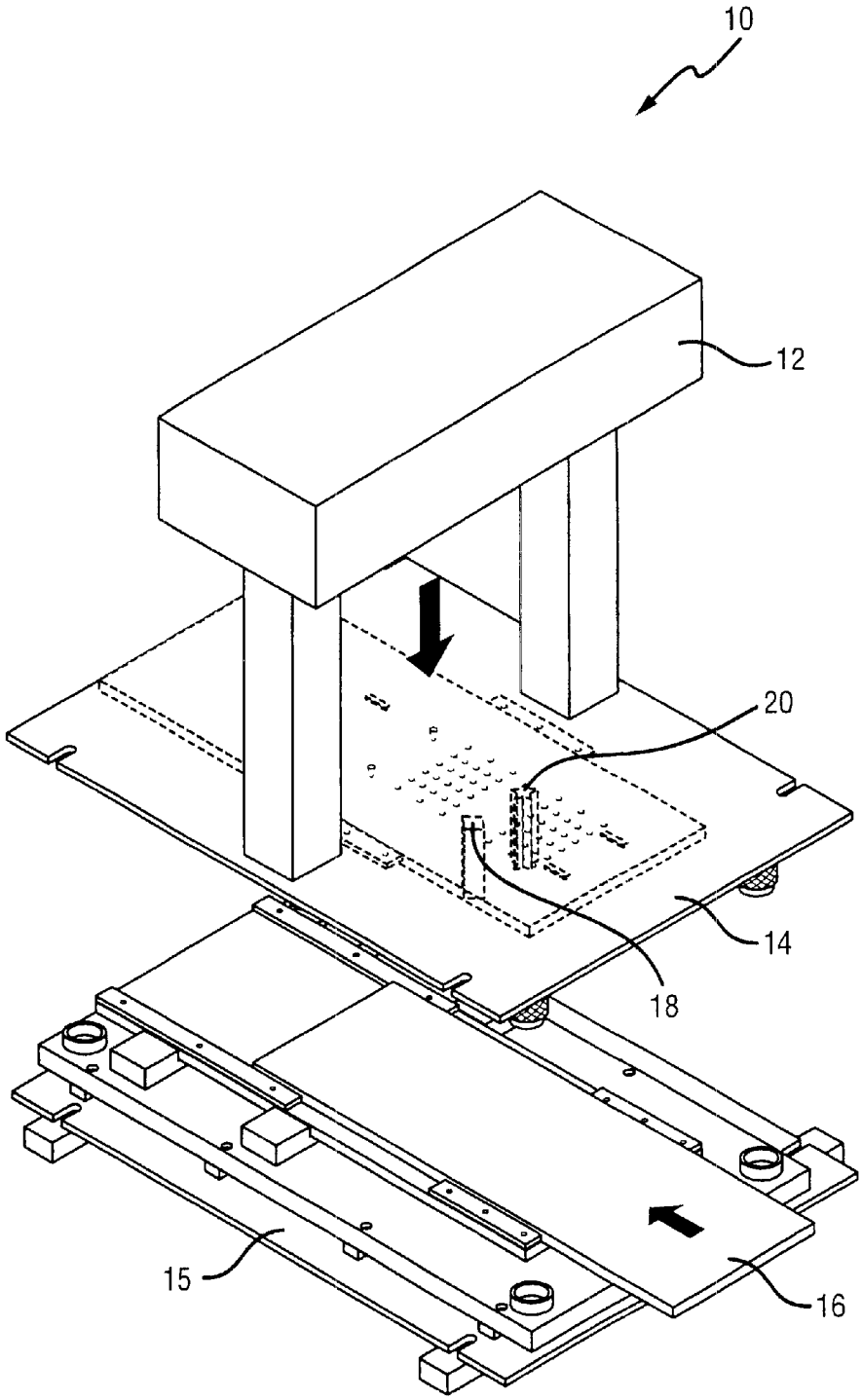
FIG. 1 is an illustration of a hard tool stamping in accordance with one embodiment of the present invention.

FIG. 1 is an illustration of a hard tool stamping 10 in accordance with one embodiment of the present invention. Hard tool stamping 10 includes a press 12 coupled to a stamping die 14. Press 12 is typically a mechanical or hydraulic press, which operates by lowering and pressing stamping die 14 against a slab of sheet metal 16. Stamping die 14 then cuts sheet metal 16 into a blank, which is a flattened piece of sheet metal that is ready to be shaped and formed into a final sheet metal product. There are many types of raw sheet metal used by the different industries. Sheet metal possesses many characteristics that vary, including thickness, grain, and temper.

Stamping die 14 may be designed to cut a blank with almost any dimension or shape from sheet metal 16 by using computer aided design (CAD) and computer aided manufacturing (CAM) software programs. The use of such programs also allows for the manufacturing of stamping dies that cut blanks within a low error tolerance from specification. In this example, stamping die 14 has been designed to cut a blank that has a rectangular shape. Stamping die 14 includes a diamond shaped stamp 18 and an arrow shaped stamp 20 for embossing a pair of correspondingly shaped markings in sheet metal 16. After a blank has been cut, stamping die 14 may be pressed against on a new slab of sheet metal to cut another identical blank.

Figure 2:
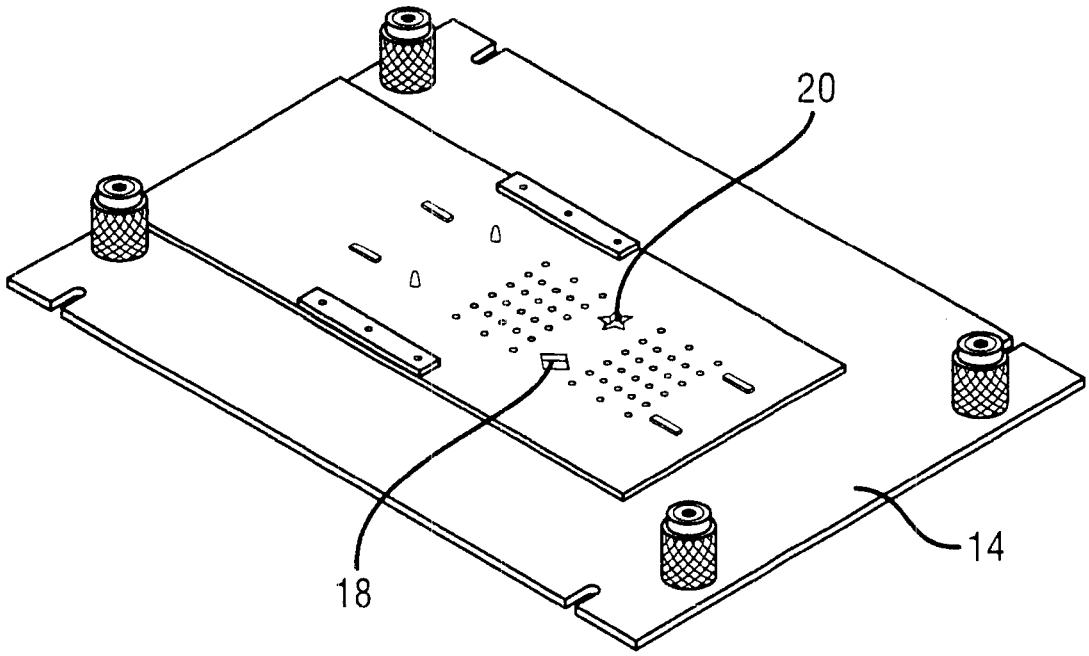
FIG. 2 is a bottom view of a stamping die in accordance with one embodiment of the present invention.

FIG. 2 is a bottom view of stamping die 14 in accordance with one embodiment of the present invention. The edges of stamping die 14 and diamond shaped stamp 18 and arrow shaped stamp 20 are pressed against sheet metal by press 12 (shown in FIG. 1) to cut a blank. Diamond shaped stamp 18 and arrow shaped stamp 20 may be configured merely to impress on the surface or to cut all the way through the sheet metal. The depth of the cut may be altered by raising or lowering the surfaces of diamond shaped stamp 18 and arrow shaped stamp 20 relative to the outer cutting edges of stamping die 14.

Figure 3:
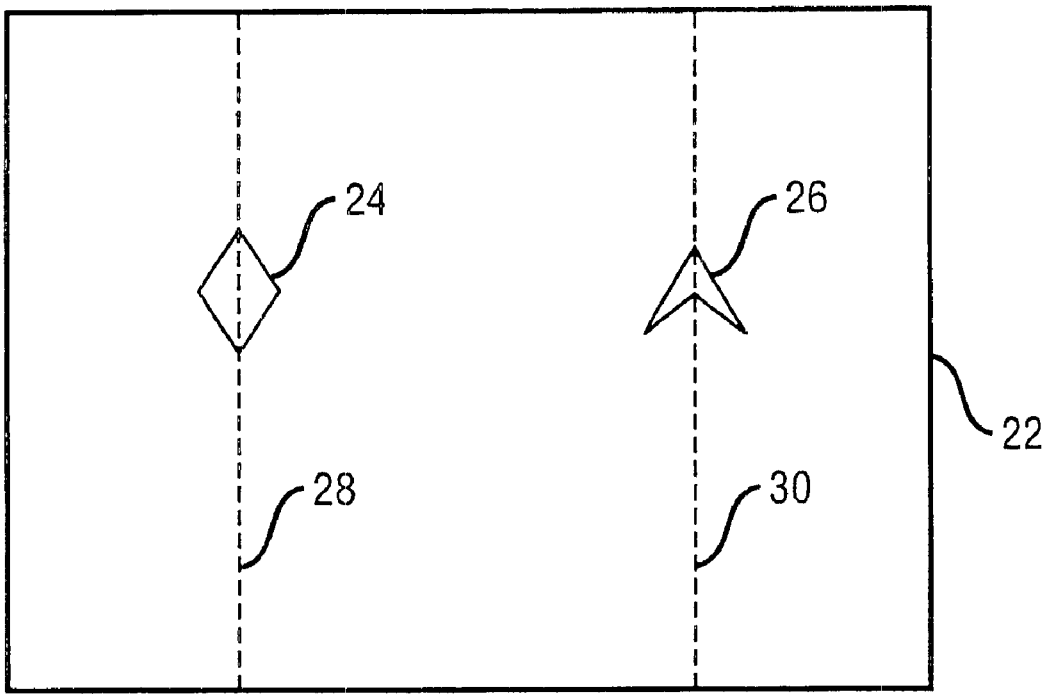
FIG. 3 illustrates a blank that was cut by a stamping die in accordance with one embodiment of the present invention.

FIG. 3 illustrates a blank 22 that was cut by stamping die 14 in accordance with one embodiment of the present invention. Blank 22 includes a diamond marking 24 and an arrow marking 26. Diamond marking 24 is centered along an imaginary forming line 28 and arrow marking 26 is centered along an imaginary forming line 30. Imaginary forming lines 28 and 30 represent lines that have been computed by the CAD/CAM programs, along which blank 22 must be bent to form the final sheet metal shape. Both diamond marking 24 and arrow marking 26 preferably include a pair of vertices positioned on imaginary forming lines 28 and 30.

Figure 4:
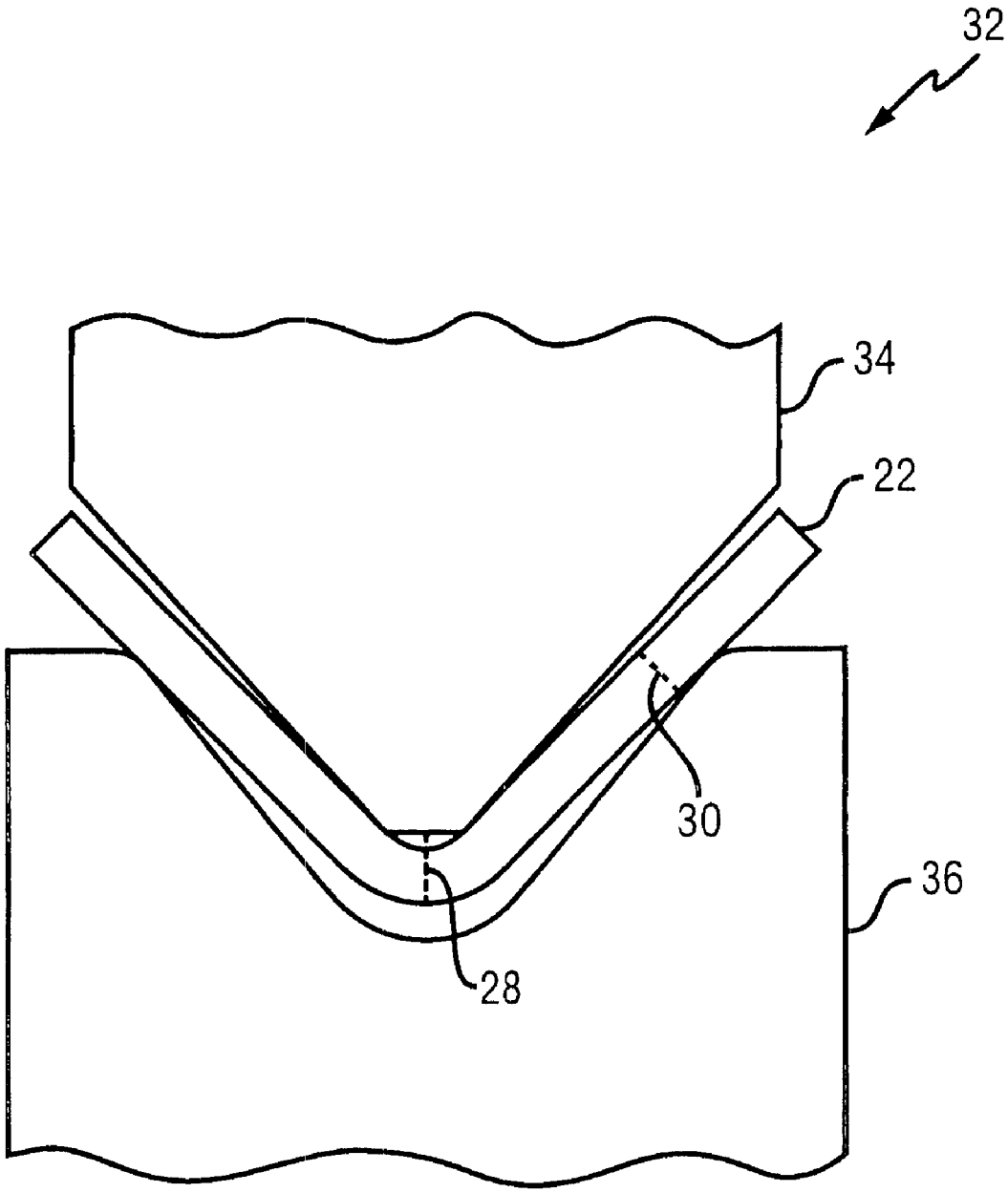
FIG. 4 illustrates a press brake in the process of bending a blank in accordance with one embodiment of the present invention.

FIG. 4 illustrates a press brake 32 in the process of bending blank 22 in accordance with one embodiment of the present invention. Press brake 32 includes a punch 34 and a die 36. Blank 22 is generally inserted manually into press brake 32 between punch 34 and die 36. Because blank 22 requires bending at imaginary forming line 28, blank 22 is inserted into press brake 32 until a back stop (not shown) detects that blank 22 is in the proper position. Punch 34 is then either mechanically or hydraulically forced into punch 36, thereby bending blank 22 at imaginary forming line 28. The process may then be repeated to bend blank 22 at imaginary forming line 30.

A major problem with using a press brake to bend sheet metal is that the process is prone to error, particularly because it requires the assistance of a human operator. In the above example, the operator must remove blank 22 from the press brake after bending blank 22 along imaginary forming line 28 and reposition blank 22 along a new back stop to bend blank 22 along imaginary forming line 30. Common errors occur in the process when the operator does not hold a blank correctly against the back stop or when the back stop is positioned incorrectly. The blank is therefore incorrectly formed as a result of these errors.

Figure 5:
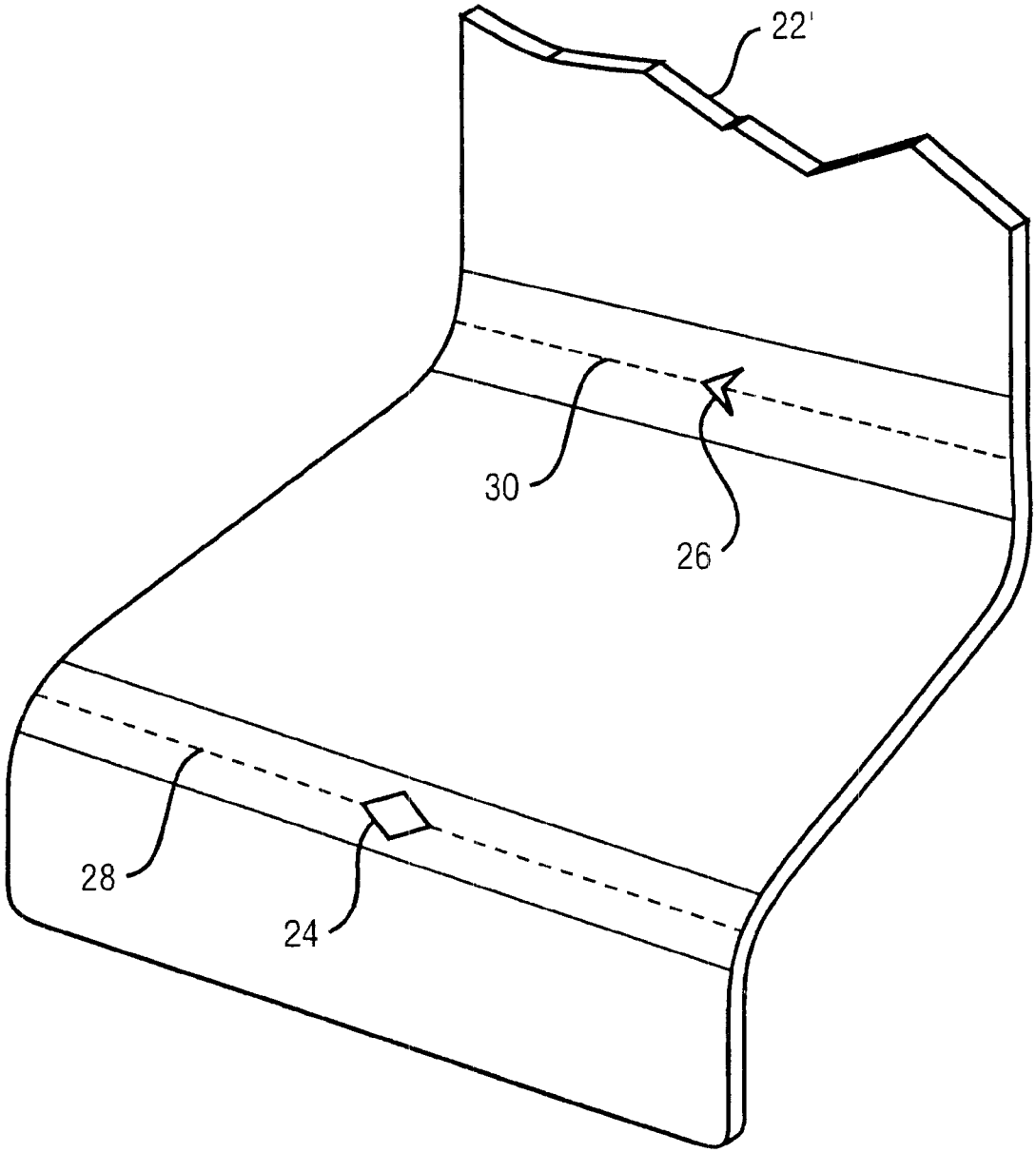
FIG. 5 illustrates a blank after it has been bent along imaginary forming lines in accordance with one embodiment of the present invention.

FIG. 5 illustrates blank 22' after it has been bent along imaginary forming lines 28 and 30 in accordance with one embodiment of the present invention. Diamond marking 24 and arrow shaped marking 26 provide an easy and efficient visual method of determining whether blank 22' has been properly bent along imaginary forming lines 28 and 30. For example, diamond marking 24 is able to represent imaginary forming line 28 along two of its vertices. If blank 22' appears to be bent along the two vertices of diamond marking 24, then it may be assumed that blank 22' has been bent correctly. If blank 22' does not appear to be bent along the vertices of diamond marking 24, then an error may have occurred in the bending process. Blank 22' may be further tested using precision measuring instruments such as calipers to determine the extent of the discrepancies. Arrow shaped marking 26 may be used in the same way to determine whether blank 22' has been properly bent along imaginary forming line 30. Furthermore, the width of the markings may be used as a visual indication of whether the width of the bended area of the workpiece is correct. The markings therefore allow for quick determination of whether or not a piece of sheet metal has been properly bent.

Figure 6:
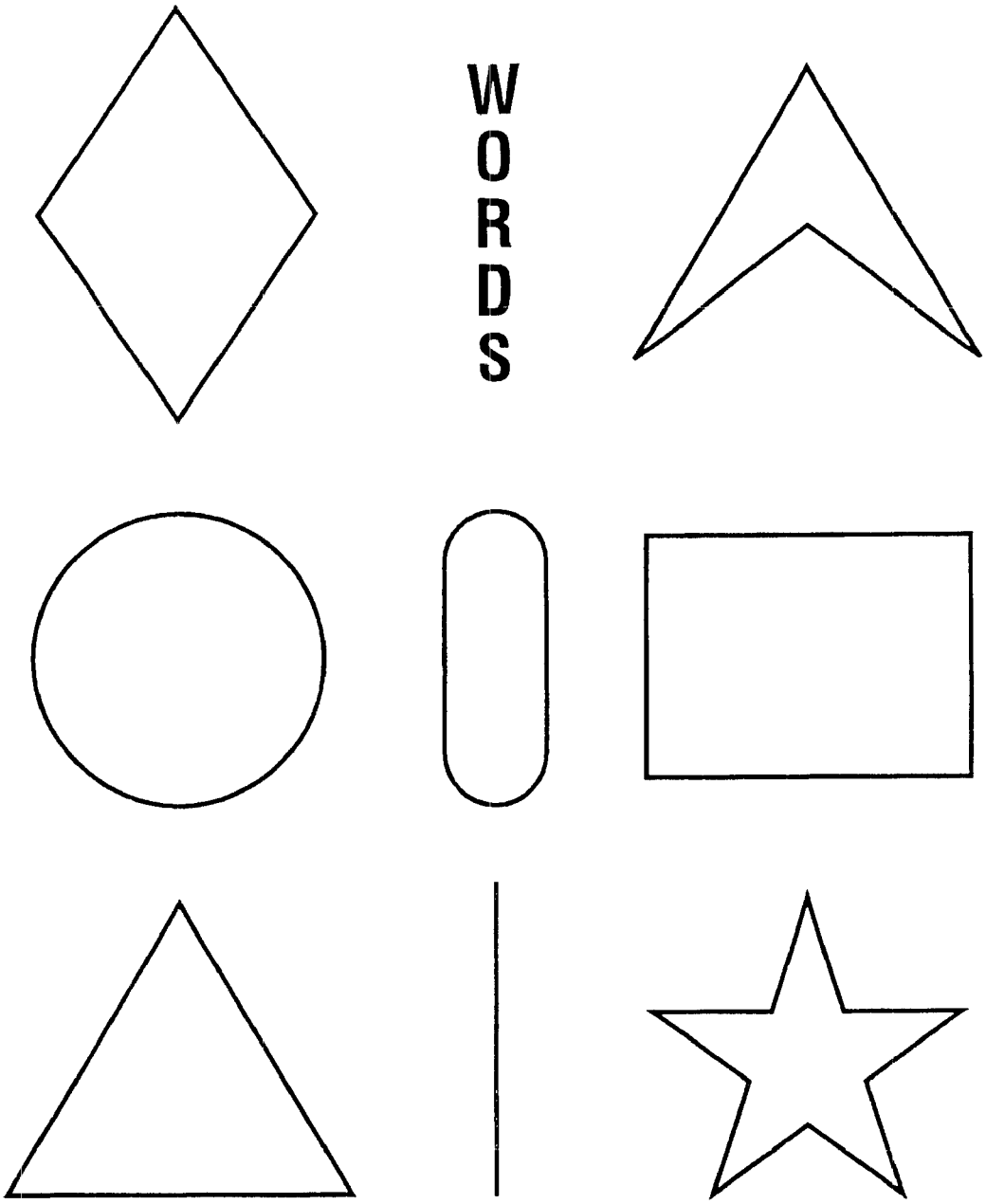
FIG. 6 illustrates a variety of markings that may be embossed on sheet metal along an imaginary forming line in accordance with the present invention.

FIG. 6 illustrates a variety of markings that may be embossed on sheet metal along an imaginary forming line in accordance with the present invention. The markings comprise mainly of shapes that preferably include at least two vertices along which the sheet metal is bent. However, depending on the precision with which the sheet metal is bent, other shapes that allow for quick visual determination of error may also be used (e.g. through their inherent symmetry around the imaginary forming line). The markings may penetrate the sheet metal either partially or completely depending on whether the markings need to be visible on both sides and also depending on the strength of the particular sheet metal.

Figure 7:
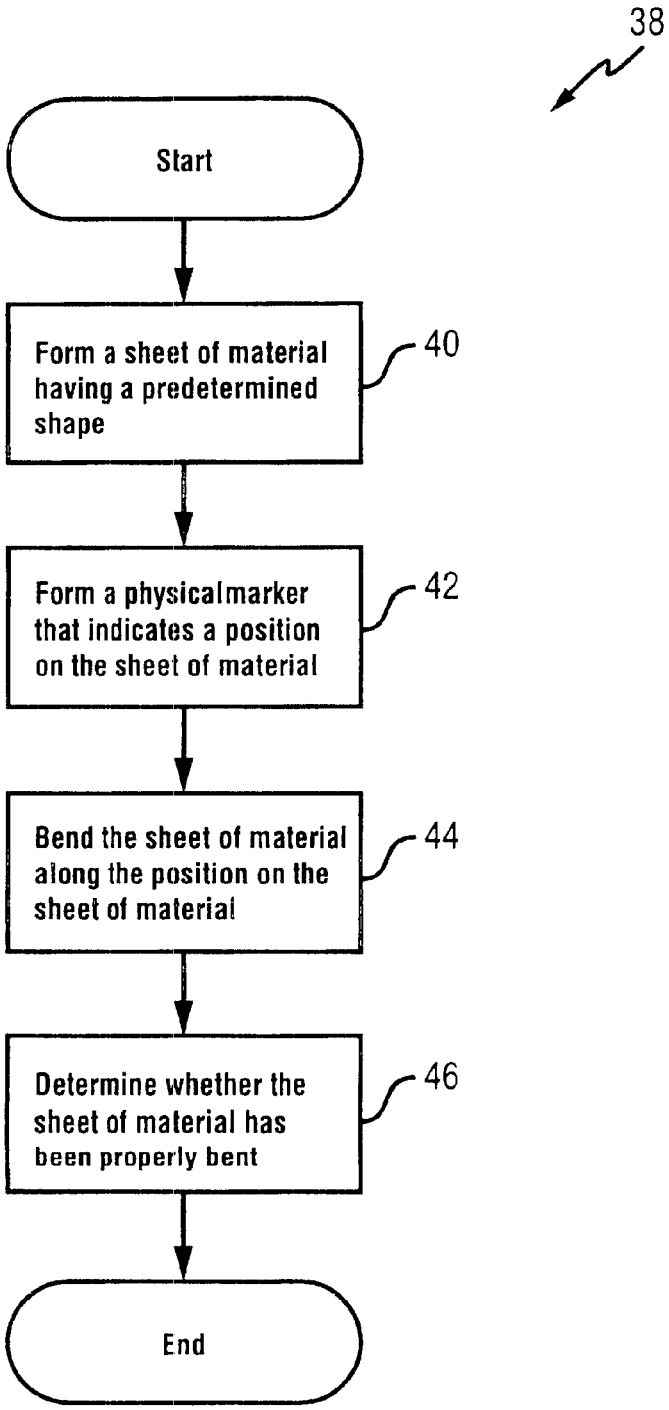
FIG. 7 is a flowchart of a method of forming and using markings to determine if a sheet metal part has been bent correctly in accordance with one embodiment of the present invention.

FIG. 7 is a flowchart of a method 38 of forming and using markings to determine if a sheet metal part has been bent correctly in accordance with one embodiment of the present invention. Method 38 begins at block 40 by forming a sheet of material having a predetermined shape. The material, which is typically sheet metal is formed into a predetermined shape (a blank) by cutting it from a larger piece of sheet metal. The blank may be cut using a hard tool stamping or a laser. The hard tool stamping forces a stamping die against the piece of sheet metal to cut a blank.

A physical marker is then formed, either through the stamping die of the hard tool stamping or by using a laser in block 42. The physical marker indicates a position, such as an imaginary forming line, on the blank where the blank will later be bent. The blank is then bent in block 44, usually by inserting the blank into a press brake, which bends the blank along the imaginary forming line. The operator then observes the bent blank, using the physical marker to see whether or not the blank has been bent correctly in block 46. The operator may then decide whether the bent blank may proceed to the next part of the manufacturing process or be discarded or be further tested for errors.

Other embodiments of the invention will be apparent to those skilled in the art from consideration of the specification and practice of the invention. Furthermore, certain terminology has been used for the purposes of descriptive clarity, and not to limit the present invention. The embodiments and preferred features described above should be considered exemplary, with the invention being defined by the appended claims.

What is claimed is:

1. A workpiece, comprising:

a sheet of material bent along a bending line, wherein said material is one of a group consisting of a metal and a plastic; and a physical marking formed on said sheet of material along the bending line, wherein said physical marking is compared with said bending line shaped to accurately determine whether said sheet of material was properly bent.

2. A workpiece as recited by claim 1, wherein the sheet of material is bent by a press brake.

3. A workpiece as recited by claim 1, wherein said physical marking is formed with the aid of one of a group consisting of a computer aided design and a computer aided manufacturing software program.

4. A workpiece as recited by claim 1, wherein the physical marking is formed with a stamping die.

5. A workpiece as recited by claim 4, wherein the stamping die is operated by a hard tool stamping.

6. A workpiece as recited by claim 1, wherein the physical marking is formed with a laser.

7. A workpiece as recited by claim 1, wherein the physical marking has a depth that is less than the thickness of the sheet of material.

8. A workpiece as recited by claim 1, wherein the physical marking includes at least two vertices.

9. A workpiece as recited by claim 8, wherein the physical marking includes a diamond shape.

10. A workpiece as recited by claim 8, wherein the physical marking includes an arrow shape.

11. A method of determining whether a workpiece has been properly bent, comprising:

forming a sheet of material, wherein said material is one of a group consisting of a metal and a plastic;

forming a physical marking on said sheet of material along a bending line; bending said sheet of material along a bending line to form a workpiece; and determining whether said workpiece has been properly bent by comparing said physical marking with said bending line.

12. A method of determining whether a workpiece has been properly bent as recited by claim 11, wherein the sheet of material is bent by a press brake.

13. A method of determining whether a workpiece has been properly bent as recited by claim 11, wherein the physical marking is formed with the aid of one of a group consisting of a computer aided design or a computer aided manufacturing software program.

14. A method of determining whether a workpiece has been properly bent as recited by claim 11, wherein the physical marking is formed with a stamping die.

15. A method of determining whether a workpiece has been properly bent as recited by claim 14, wherein the stamping die is operated by a hard tool stamping.

16. A method of determining whether a workpiece has been properly bent as recited by claim 11, wherein the physical marking is formed with a laser.

17. A method of determining whether a workpiece has been properly bent as recited by claim 11, wherein the physical marking has a depth that is less than the thickness of the sheet of material.

18. A method of determining whether a workpiece has been properly bent as recited by claim 11, wherein the physical marking includes at least two vertices.

19. A method of determining whether a workpiece has been properly bent as recited by claim 18, wherein the physical marking includes a diamond shape.

20. A method of determining whether a workpiece has been properly bent as recited by claim 19, wherein the physical marking includes an arrow shape.

* * * * *